United States Patent [19]

Ingram

[11] 4,294,386

[45] Oct. 13, 1981

[54] TENNIS BALL HOLDER

[76] Inventor: Arlen E. Ingram, 32606 Barkley, Livonia, Mich. 48154

[21] Appl. No.: 115,386

[22] Filed: Jan. 25, 1980

Related U.S. Application Data

[63] Continuation of Ser. No. 912,446, Jun. 5, 1978, abandoned.

[51] Int. Cl.[3] ..... A45F 5/00

[52] U.S. Cl. ..... 224/252; 224/919; D2/400; 221/310

[58] Field of Search ..... 224/182, 45 L, 192, 224/249, 250, 252, 919, 251; 206/315 B; 150/1.5 C, 52 G; 211/14, 15; 221/309, 310; D2/400; D21/206

[56] References Cited

U.S. PATENT DOCUMENTS

| | | | |
|---|---|---|---|
| D. 238,628 | 2/1976 | Davis | D2/400 |
| D. 240,059 | 5/1976 | Lewis, Jr. | D2/400 |
| D. 242,402 | 11/1976 | Bratene et al. | D2/400 |
| 1,814,887 | 7/1931 | Bender | 224/919 X |
| 2,551,486 | 5/1951 | Burden | D21/206 |
| 2,926,912 | 3/1960 | Gould | 224/919 X |
| 3,206,067 | 9/1965 | Smith, Jr. et al. | 221/310 |
| 3,412,897 | 11/1968 | Slater | 221/310 X |
| 4,061,256 | 12/1977 | Beeret al. | 224/919 X |
| 4,062,482 | 12/1977 | Szalony | 224/252 X |
| 4,119,247 | 10/1978 | Newquist | 224/919 X |

FOREIGN PATENT DOCUMENTS

| | | | |
|---|---|---|---|
| 1056460 | 2/1954 | France | 224/45 L |

*Primary Examiner*—Steven M. Pollard

*Attorney, Agent, or Firm*—Barnes, Kisselle, Raisch & Choate

[57] ABSTRACT

A holder for tennis balls which can be worn on the person playing tennis by attachment to a garment having a cage to retain the ball, the cage having a top opening for receiving and restraining the ball from escape at the top and having resilient retaining fingers that restrain the ball at the bottom but which allow the ball to be pushed out when needed by thumb pressure of one hand at the top of the ball, the fingers of the same hand receiving the ball so that it may be put in play.

5 Claims, 14 Drawing Figures

TENNIS BALL HOLDER

This is a continuation of application Ser. No. 912,446, filed on June 5, 1978 and abandoned in favor of this application.

This invention relates to a tennis ball holder and more particularly to a holder which can be worn on the person.

In the game of tennis, two serves are permitted. Thus, the server must have at hand two balls so that the second one can be used if the first serve is a fault. It has been common for a player to hold two balls in the left hand, if the player is a right-handed person, so the first ball may be tossed in the air and served. If the serve is good, the second ball is immediately discarded as the play continues from the serve. If the first serve is not good, the second ball is in hand for the second serve.

This has disadvantages in that the holding of two balls in the left hand for the first serve may interfere with the ball toss for the first serve, and this may compromise the effectiveness of the first serve. Also, if the first serve is good and the second ball is tossed away, it may come to rest in the playing area and cause a misstep or a sprained ankle. Attempts have been made to alleviate this problem by using pockets in the tennis uniforms large enough to hold a tennis ball. This detracts from the neatness of the uniform and also causes delay in the extracting of the second ball for a second serve. If the second ball is not needed, there is a bulge in the uniform which is unsightly.

There have been attempts to solve this problem also by cages attachable to a belt, but these have simply provided a cup-like device which required removable of the ball from the top.

The present invention is directed to a ball holder which is attachable to the body by a belt loop or clip or other means, which device is loaded from the top. When it is desired to use the second ball, it is ejected through the bottom of the device by thumb pressure and the ball moves into the fingers and hand of the player for immediate use.

Objects and features of the invention will be apparent in the following description and claims directed to the best mode presently contemplated for the practice of the invention.

Figure 1:
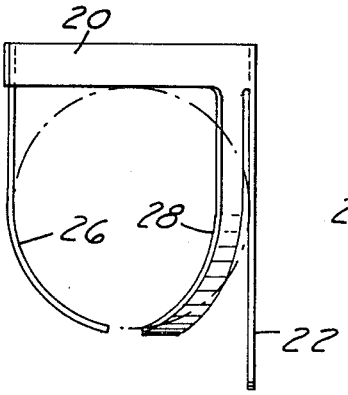
Figure 2:
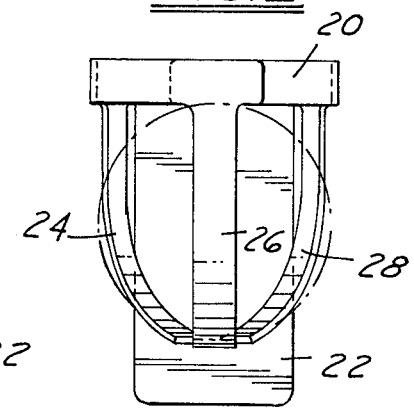
Figure 3:
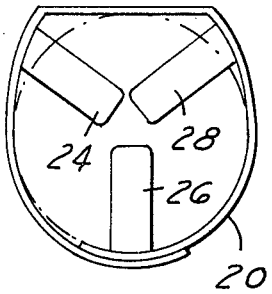

Drawings accompany the disclosure, and the various views thereof may be briefly described as:

FIGS. 1, 2 and 3, side, front, and top views of a first embodiment of the invention.

Figure 4:
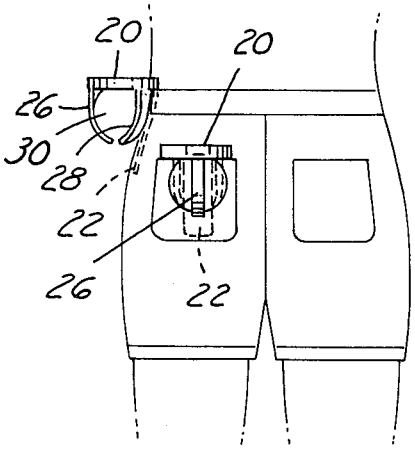

FIG. 4, a view showing the attachment of the device to a garment.

Figure 5:
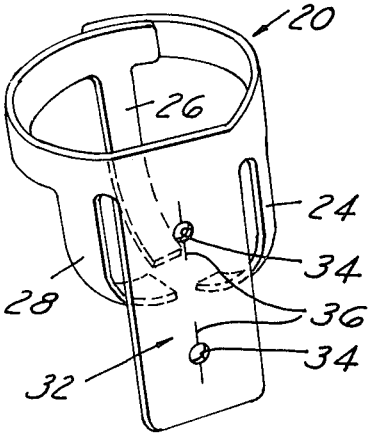

FIG. 5, a modified button attachment.

Figure 6:
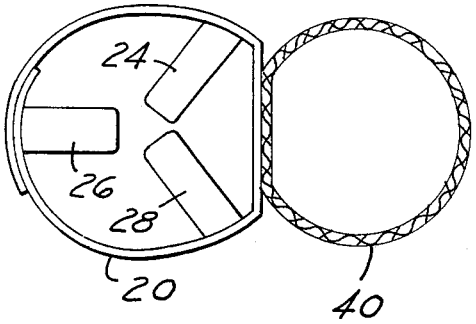

FIG. 6, a wrist band attachment.

Figure 7:
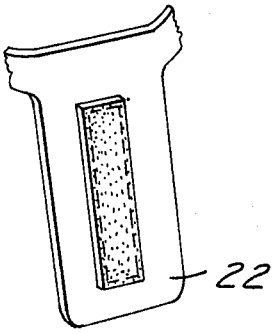

FIG. 7, a Velcro attachment.

Figure 8:
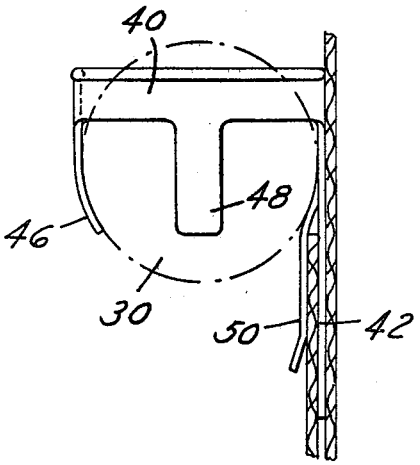

FIG. 8, a side view of an embodiment showing an out-of-round structure for ball retention.

Figure 9:
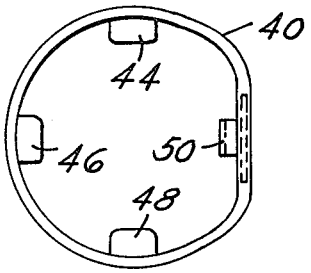
Figure 10:
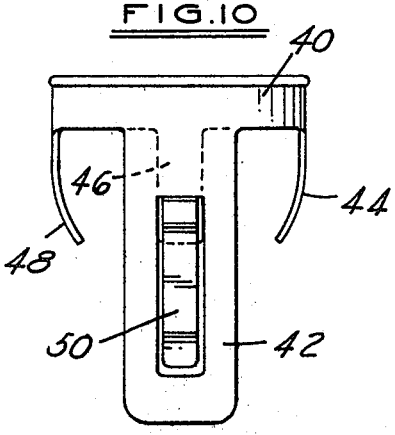

FIGS. 9 and 10, top and front views of the embodiment of FIG. 8.

Figure 11:
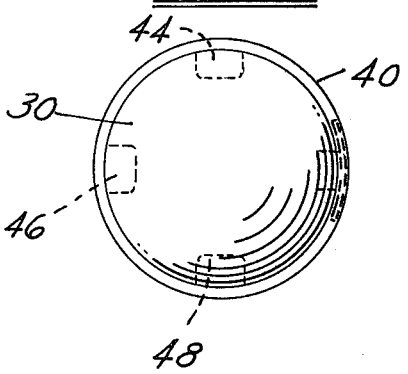

FIG. 11, a top view showing flex-out of the top of the retainer frame.

Figure 13:
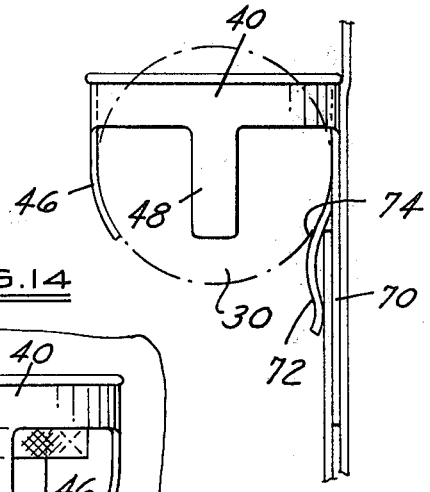
Figure 12:
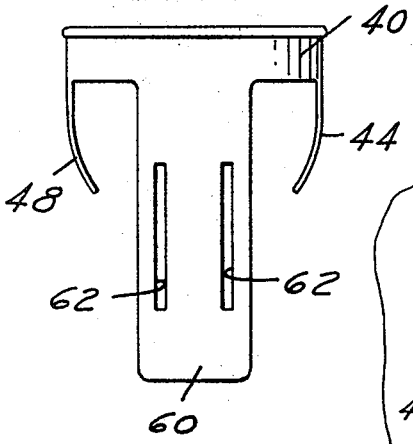

FIGS. 12 and 13, front and side views of a clip type retainer.

Figure 14:
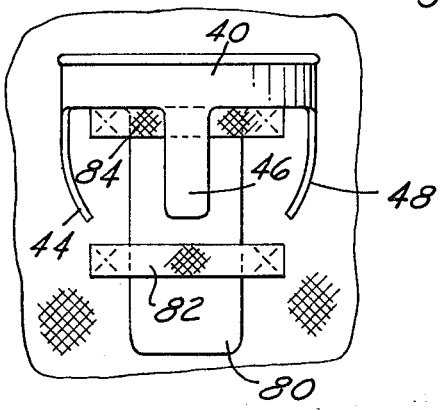

FIG. 14, a front view of a tab and loop retainer.

In FIGS. 1, 2, 3 and 4, a first embodiment is shown wherein a top ring 20, with overlapping ends, dimensioned to allow a tennis ball to slip through it with slight pressure, has four depending tabs. The first tab 22 is relatively broad and extends straight down. Three additional tabs 24, 26 and 28 depend straight down for a portion of their length and then curve inwardly to provide a support for a tennis ball 30 (FIG. 4). These tabs 24, 26 and 28 are flexible in nature, having enough resilience to support a ball but also to allow a ball to be pushed out of the bottom of the cage by thumb pressure from the top. The entire device can be of a molded plastic, the upper ring being flexible to allow entry of the ball. The tab 22 can be inserted in the belt of a garment or into a back pocket as shown in FIG. 4.

In FIG. 5, a modified back tab 32 has holes 34 and slits 36 to enable the holder to be buttoned on to a garment.

In FIG. 6, a resilient wrist or arm band 40 is shown which can be used to hold the device on the arm of the player.

In FIG. 7, the tab 22 has a strip of Velcro (interlocking hook fabric) on the back to permit fastening to a cooperating strip on the player's garment.

In FIGS. 8, 9, 10 and 11, a modified unit is shown, again made of a molded plastic. In this embodiment, a closed ring 40 has a back tab 42 and three depending curved retaining tabs 44, 46 and 48. The tab 42 has a struck-out clip portion 50 to cooperate with a pocket, for example, as shown in FIG. 8 to retain the device on a garment.

The closed ring 40 has a flat 52 at the back side such that when the ball is inserted into the ring, this flat can stretch out to a circle as shown in FIG. 11 to allow the ball to enter but it will return to its shape to retain the ball after insertion. In this embodiment as in the previous embodiment, the retained ball can be pushed through the flexing tabs 44, 46 and 48 to fall into the fingers and hand for immediate use.

In FIG. 12, a back tab 60 has slits 62 for the passage of a belt for retention. In FIG. 13, the back tab 70 has a struck-out clip element 72 curved outwardly and then back to provide a retaining clip and also to serve as a ball support at 74. In FIG. 14, a plain tab 80 slips through fabric loops 82, 84 secured on to a garment.

In each embodiment, the ball is pushed through the top retention loop or ring where is rests in the holder supported by the curved depending tabs. When needed, the player can simply press downwardly and pop the ball into his hand. Meanwhile, when not needed for a second serve, the ball is carried in a way which prevents interference with the game.

I claim:

1. A tennis ball holder attachable to the garment of a player and constructed and arranged to receive and hold only one tennis ball at a time, comprising a homogeneously integral one-piece body of a plastic material having a retainer ring which is flexible, resilient, form-retaining, and can be disposed in a generally horizontal plane with its central axis extending generally vertically, a plurality of discreet and generally circumferentially spaced apart fingers each at its proximal and homogeneously integral with said ring and depending normally generally downwardly from said ring and having its distal end curved generally inwardly of said ring toward its center axis and terminating at a point spaced from said center axis and the distal end of the other of said fingers, each said finger being flexible, resilient, form-retaining, and constructed and arranged so that its distal end, in the unflexed position of such finger, underlies and supports a single tennis ball inserted through said ring and can be yieldably moved away from said center axis to allow the tennis ball to be manually pushed generally downwardly beyond the distal end, out of the holder and into the fingers and hand of a user by pressure manually applied to the top of the tennis ball by the thumb of the same hand of the user extending through said ring, said ring being constructed, arranged, and dimensioned to yieldably permit the tennis ball to pass therethrough and into engagement with said flexible fingers and in its normal unflexed state to retain the tennis ball between said ring and said fingers, and a tab homogeneously integral with said ring and being constructed and arranged for attaching the holder to the garment of a tennis player.

2. The tennis ball holder of claim 1 wherein said retainer ring is a split ring constructed and arranged to yieldably expand from its normal unflexed position to permit a tennis ball to pass therethrough and to return to its unflexed position to retain the ball in the holder between said ring and said fingers.

3. The tennis ball holder of claim 1, wherein said tab also comprises a homogeneously integral clip element constructed and arranged such that a first portion curves generally inwardly toward the center axis of said ring and extends generally downwardly to bear on a ball received in said holder, and a second portion extends generally downwardly to cooperate with said tab in retaining the holder on a garment.

4. The tennis ball holder of claim 1, wherein said retainer ring is continuous and in its normal unflexed position, is not circular throughout and will flex from such normal position to permit a tennis ball to pass therethrough and will return to such normal unflexed position to retain the ball and holder between said ring and said fingers.

5. The tennis ball holder of claim 4, wherein said tab also comprises a homogeneously integral clip element constructed and arranged such that a first portion curves generally inwardly toward the center axis of said ring and extends generally downwardly to bear on a ball received in said holder, and a second portion extends generally downwardly to cooperate with said tab in retaining the holder on a garment.

* * * * *

UNITED STATES PATENT AND TRADEMARK OFFICE

CERTIFICATE OF CORRECTION

PATENT NO. : 4,294,386

DATED : October 13, 1981

INVENTOR(S) : Arlen E. Ingram

It is certified that error appears in the above-identified patent and that said Letters Patent are hereby corrected as shown below:

Col. 2, Line 58, change "and" to -- end --.

Signed and Sealed this

*Ninth* Day of *February 1982*

[SEAL]

*Attest:*

GERALD J. MOSSINGHOFF

*Attesting Officer*

*Commissioner of Patents and Trademarks*